US006220021B1

(12) United States Patent
Frederiksen et al.

(10) Patent No.: US 6,220,021 B1
(45) Date of Patent: Apr. 24, 2001

(54) SILENCER WITH INCORPORATED CATALYST

(75) Inventors: Svend Frederiksen, Copenhagen; Lars Frederiksen, Gentofte, both of (DK)

(73) Assignee: Silentor Notox A/S, Hedehusene (DK)

( * ) Notice: Subject to any disclaimer, the term of this patent is extended or adjusted under 35 U.S.C. 154(b) by 0 days.

(21) Appl. No.: 08/952,467

(22) PCT Filed: May 19, 1995

(86) PCT No.: PCT/DK95/00200

§ 371 Date: Jan. 16, 1998

§ 102(e) Date: Jan. 16, 1998

(87) PCT Pub. No.: WO96/36796

PCT Pub. Date: Nov. 21, 1996

(51) Int. Cl.[7] ..... F01N 3/28
(52) U.S. Cl. ..... 60/299; 422/176
(58) Field of Search ..... 60/299, 308; 422/176

(56) References Cited

U.S. PATENT DOCUMENTS

| | | | | |
|---|---|---|---|---|
| 2,677,231 | * | 5/1954 | Cornelius | 60/308 X |
| 3,852,042 | * | 12/1974 | Wagner | 60/299 X |
| 3,897,853 | | 8/1975 | Frederiksen | 181/57 |
| 3,899,303 | | 8/1975 | Gaysert . | |
| 3,984,207 | * | 10/1976 | Abthoff et al. | 60/299 X |
| 3,989,471 | * | 11/1976 | Nowalk | 60/299 X |
| 4,004,887 | * | 1/1977 | Stormont | 60/299 X |
| 4,032,310 | * | 6/1977 | Ignoffo | 60/302 X |
| 4,050,903 | * | 9/1977 | Bailey et al. | 60/299 X |
| 4,094,645 | * | 6/1978 | Bailey | 60/299 X |
| 4,109,753 | * | 8/1978 | Lyman | 181/252 |
| 4,209,493 | * | 6/1980 | Olson | 422/176 |
| 4,601,168 | * | 7/1986 | Harris | 60/299 |
| 4,848,513 | | 7/1989 | Csaszar . | |

(List continued on next page.)

FOREIGN PATENT DOCUMENTS

| | | |
|---|---|---|
| 2307215 | 2/1973 | (DE) . |
| 2428964 | 6/1974 | (DE) . |
| 2429002 | 6/1974 | (DE) . |

(List continued on next page.)

OTHER PUBLICATIONS

M.A. Barris, "Development of Diesel Exhaust Catalytic Converter Mufflers", International Congress and Exposition, Detroit, Michigan, Feb. 24–27, 1992.

Volvo Cityfilter. Brochure, (No Date Available).

"Rene busser er til guan for bade dig og miljoet" ("Clean busses are good for both you and the environment") (6–pages –plus 4 pages of English Translation).

"Ny Volvo–katalysator til busser Miljotilpasser den Kollektive trafik" ("New Volvo catalyst for busses makes public transport environmentally friendly") (1 page –plus 3 pages of English Translation) Jan. 10, 1995.

*Primary Examiner*—John E. Ryznic
(74) *Attorney, Agent, or Firm*—Birch, Stewart, Kolasch & Birch, LLP

(57) ABSTRACT

Silencer with built-in catalyser which utilises a given total space optimally for simultaneous sound attenuation and catalytic treatment of gases, e.g. exhaust gases from internal combustion engine. The silencer with built-in catalyser comprises a casing (1) connected to an inlet pipe (2) and to an outlet pipe (3), a sound attenuation compartment (4), a downstream catalytic body (5), a flow-area widening diffuser element (6) extending from the inlet pipe and contained within the compartment, and a cross-plate (7) which is positioned between the diffuser element and the catalytic body and from which the flow is distributed evenly across the inlet to the catalytic body. At least two openings (8) are provided between the diffuser element and the catalytic body, at least one such opening (9) providing a communication to the sound attenuation compartment and at least two such openings (10) being pervaded by gas flows.

8 Claims, 2 Drawing Sheets

U.S. PATENT DOCUMENTS

Figure 1:
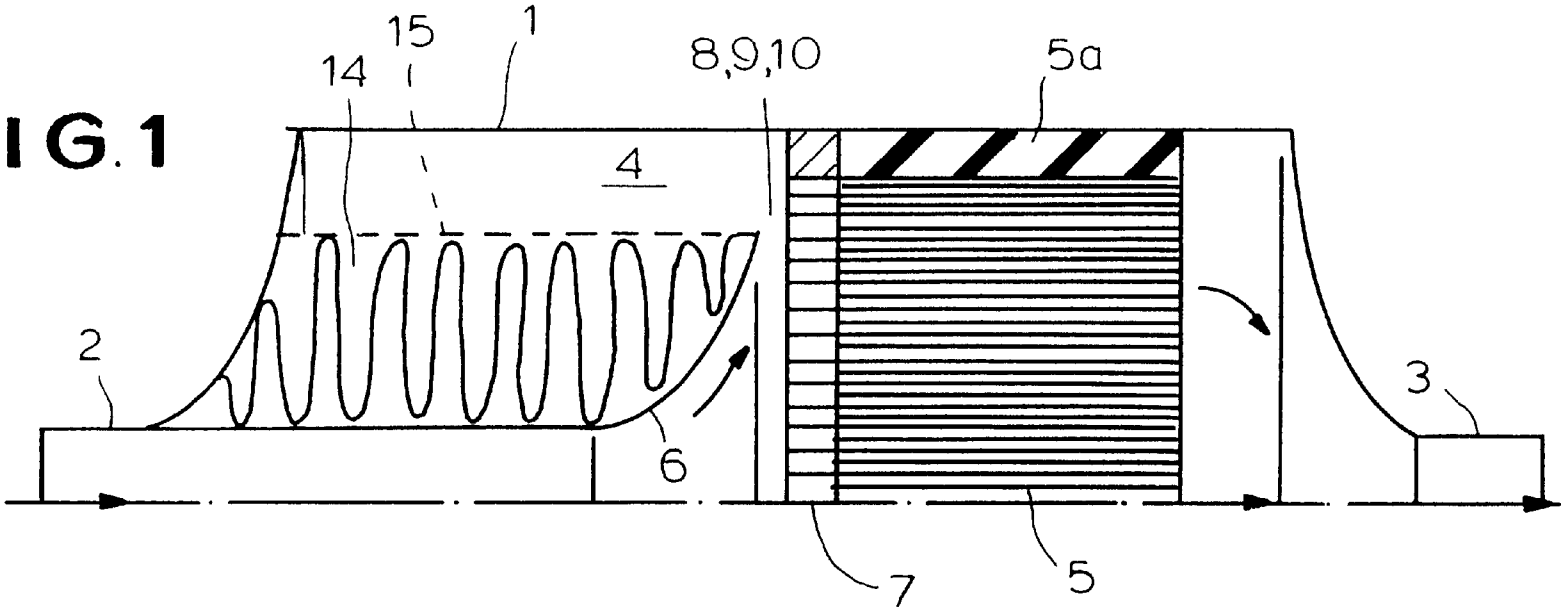

| | | | | |
|---|---|---|---|---|
| 5,016,438 | * | 5/1991 | Harris | 60/299 |
| 5,043,147 | | 8/1991 | Knight . | |
| 5,065,576 | * | 11/1991 | Kanazawa et al. | 60/299 X |
| 5,150,573 | | 9/1992 | Maus et al. | 60/299 |
| 5,184,464 | * | 2/1993 | Harris | 60/299 |
| 5,220,789 | * | 6/1993 | Riley et al. | 422/176 X |
| 5,248,859 | * | 9/1993 | Borla | 181/238 |
| 5,351,483 | * | 10/1994 | Riley et al. | 60/274 |
| 5,355,973 | | 10/1994 | Wagner et al. | 60/299 X |
| 5,378,435 | * | 1/1995 | Gavoni | 422/177 |
| 5,396,764 | * | 3/1995 | Rao et al. | 60/274 |
| 5,396,767 | * | 3/1995 | Suzuki | 60/299 X |
| 5,398,407 | * | 3/1995 | Stuer | 29/890 |
| 5,403,557 | | 4/1995 | Harris . | |
| 5,408,827 | * | 4/1995 | Holtermann et al. | 60/302 X |
| 5,408,828 | * | 4/1995 | Kreucher et al. | 60/299 |
| 5,426,269 | * | 6/1995 | Wagner et al. | 181/232 |
| 5,484,575 | * | 1/1996 | Stennackers | 422/176 |
| 5,737,918 | * | 4/1998 | Khinsky et al. | 60/299 X |
| 5,758,497 | * | 6/1998 | Frederiksen et al. | 60/299 |
| 5,828,013 | * | 10/1998 | Wagner et al. | 60/299 X |
| 5,829,132 | * | 11/1998 | Sickels et al. | 422/177 X |
| 5,921,079 | * | 7/1999 | Harris | 60/299 X |

FOREIGN PATENT DOCUMENTS

| | | |
|---|---|---|
| 3039742 | 10/1980 | (DE) . |
| 4130113 | 9/1991 | (DE) . |
| 128427 | 11/1971 | (DK) . |
| 169823 | 2/1993 | (DK) . |
| 158625 | 3/1985 | (EP) . |
| 410924 | 7/1990 | (EP) . |
| 556846 | 2/1993 | (EP) . |
| 683849 | 1/1994 | (EP) . |
| 4-072414 | 3/1992 | (JP) . |
| 5-237397 | 9/1993 | (JP) . |
| 169581 | 7/1990 | (NO) . |
| 93 24744 | 12/1993 | (WO) . |
| 94 10430 | 5/1994 | (WO) . |
| 94 18438 | 8/1994 | (WO) . |

* cited by examiner

SILENCER WITH INCORPORATED CATALYST

The present invention discloses a silencer with a built-in catalyst which utilises a given total space optimally for simultaneous silencing and conversion of noxious exhaust gases, typically exhaust gases from prime mover internal combustion engines.

The invention utilises diffuser technology in a novel way, in that a special design of a built-in diffuser is adopted, both for sound attenuation and for even distribution of exhaust gas flow to the inlet face of a catalyser body.

As a consequence of ever more stringent environmental regulations, demands for low exhaust noise levels and for low levels of particle and noxious gas emissions to the atmosphere are increasing all the time. In addition, it is required that the flow resistance provided by silencers, catalysts, etc. be as small as possible, in order that the back-pressure to the engine can be kept as low as possible. This poses a problem to the exhaust system designer, since the available under-vehicle space is normally restricted.

A first step towards space economy, which has been adopted already, is to combine silencers and catalysts by inserting a catalysts inside the casing of a silencer. Even a simple catalysts containing canister causes some noise attenuation, by virtue of its acoustic volume or by throttling of the exhaust flow. In the case of a catalytic body with uninterrupted, straight channels of low pressure drop, however, the attenuation effect of the catalysts as such is only marginal, which can be shown by removing the catalytic body and by measuring how this influences the exhaust noise level outside the exhaust pipe system. Wall-flow catalysts, in which gases are forced to follow tortuous pathways inside the catalyst body, are more effective in suppressing noise, but such devices also cause rather high pressure drops.

In diesel engine exhaust systems accumulation of particulate matter is sometimes a problem. In catalysts particulate matter which is not converted tends to hamper the conversion process and to cause increased pressure drop. This problem, which at present receives much attention, primarily refers to the design of the catalyst as such, but should also be addressed when developing concepts for combined silencer catalysts.

Various sorts of diffusers have been utilised as flow distribution arrangements in front of catalysts and as flow elements in silencers.

In the first case these arrangements are answers to the following problem: Supposing that a catalysts is positioned close to an inlet pipe of substantially smaller diameter, how can an even flow distribution across the diameter of the catalysts be achieved? The demand for a close positioning results from an overall demand for compactness.

Many types of diffusers have been suggested as solutions to this flow distribution problem. Examples of this are: German Offenlegungsschrift no. 24 28 966, which describes a pure flow line diffuser and German Offenlegungsschrift no. 24 29 002, which describes arrangements with a plurality of flow dividing cones. The latter type of solution resembles well-known arrangements incorporating guide vanes in front of steam boiler exhaust catalysts, as well as 'splitter' type diffusers commonly used in ventilating ductwork. German Offenlegungsschrift no. 24 28 964 and Norwegian utlegningsskrift no. 169581 both disclose more original diffuser catalyser arrangements.

German Offenlegungsschrift no. 2 307 215 describes a diffuser-type arrangement in which a perforated, conical member is inserted into a conical end cap at the inlet to a catalyst. This arrangement divides the rather small cavity in front of the catalyst into a flow distributing first cavity with radial diffuser properties and a second, flow mixing cavity immediately in front of the catalyser.

However, none of these solutions take acoustic aspects into consideration. To an extent this is inherent in the above formulation of the catalyst flow distribution problem, according to which the space in front of the catalytic body should be minimised, thereby significantly reducing the acoustic chamber effect. Of course, the gas volume contained within the catalytic body as such may provide some acoustic chamber effect. But from a sound attenuation point of view it is less expedient to arrange the inlet pipe / chamber flow area expansion at the upstream end of the casing. The reason is that this type of geometry tends to excite the fundamental acoustic chamber resonance maximally. This mode corresponds to a wavelength twice the acoustic chamber length, with a pressure node in the middle and maximum pressure variations at each end of the chamber.

Danish patent no. 128427 discloses a type of silencer in which a radial diffuser is utilised for achieving a low pressure drop and for positioning the outflow from the inlet pipe exactly in the middle along the length axis of a chamber, which suppresses the fundamental acoustic mode of the chamber. Danish patent no. 169823 discloses how special type diffusers with narrow, axial outflows into acoustic compartments can be adopted for suppressing lateral, resonant gas vibrations, which is particularly relevant in the case of silencers with a large casing diameter compared to pipe diameters.

This last-mentioned patent in a sub-claim also describes the possibility of utilising a radial flow property of axial outflow diffusers to obtain a flow distribution effect in front of a catalyst inserted into the silencer. However, due to the narrow lateral extension of the diffuser outflow, this tends to require that the catalytic body be of a ring-type cross section. In the case of a large diameter casing this could for instance be provided for by dividing the catalytic body into several parallel elements. But in the case of long and not too wide casings, as are generally required for under-vehicle installations, much speaks in favour of retaining a simple cylinder form of the catalytic body. In such a case the rather narrow axial outflow at a considerable distance from the centerline is less expedient in providing flow to the center of the inlet face of the catalytic body.

In the present invention the silencing and flow distributing objectives are met simultaneously by utilising a novel, special type of diffuser provided with, as a minimun 2, but in general further, apertures, as can be seen from FIG. 1 which shows a first embodiment of the invention.

Here, an acoustic compartment 4 and a catalytic body 5 are both fitted into a casing 1, which is connected to an inlet pipe 2 and to an outlet pipe 3. An elastic layer 5*a* holds the catalyst and protects it from undue mechanical forces. The diffuser element 6 and the juxtaposed cross-plate flange 7, provided with apertures 8, 10, together constitute a pressure recovering and flow distributing cross-plate diffuser. Due to the rather big aperture 8, 9, 10 it is ensured that a significant proportion of the acoustic energy present in the gas is transmitted into the compartment 4, in which sound-absorbing material 14 is inserted inside a perforated pipe 15.

In FIG. 1, as well as in the following figures, apertures are numbered according to a system. Thus, the number 8 is used for apertures in general, irrespective of type, while 9 is used for such apertures as communicate with the compartment 4, and 10 is used for apertures which are pervaded by a flow. Thus, since the comparatively big aperture in FIG. 1 both communicates with the compartment 4 and is pervaded by a flow, both characterising numbers 9 and 10 have been attached to this aperture.

Figure 2:
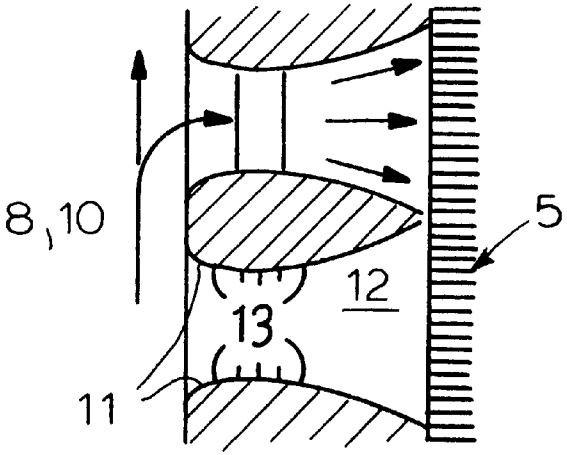

FIG. 2 shows an enlarged detail of the embodiment of FIG. 1, as an example of how apertures 8, 10 of the cross-plate 7 can be designed. Here, at the inlets to apertures, curvatures 11 have been provided for. The width of the cross-plate is shown to be of some size, so that the length of the apertures can be made significant. This in turn makes it possible to design the downstream ends of the apertures with gradually increasing cross-sectional areas. Hereby the apertures become small venturi-like diffusers.

The cross-plate diffuser constitutes an original type of diffuser arrangement, which is very appropriate for the present purpose, and which can be designated as a multiple-double diffuser. In an optimised design, both the flow distribution and the pressure recovery functions are provided for with a high degree of efficiency. This optimisation will include design of the aperture geometries. For instance, the widths of the apertures can be made a function of their distance from the center axis of the casing, in order that exit velocities are equal from individual apertures positioned at various radii.

In embodiments where the apertures are positioned close to each other, as is the case in FIG. 2, it is possible to design the cross-plate to be placed immediately adjacent to the inlet face of the catalytic body in such a way that gas flows enter virtually all parallel channels of the catalyst. For instance, this can be done by forming the apertures as peripheral slots. Thus, designing the apertures in this way opens up for the possibility of positioning the cross-plate in a direct mechanical contact with the catalyst.

In apparatuses with small, flow pervaded apertures 8, 10 the risk of blocking caused by accumulation of particulate matter may call for attention. Designing the apertures to a streamlike flow form, avoiding local recirculation zones, tends to lessen the problem. The risk of this unwelcome phenomenon can be further minimised by providing catalytic layers onto the inner surfaces 13 of the apertures.

The rather thick cross-plate flange 7 shown in FIGS. 1 and 2 can be manufactured from cast iron. As an alternative, the cross-plate can be manufactured as part of the catalyst element. Such a radical step of integration can be made in case the catalyst is manufactured from a metallic foil substrate, which easily lends itself to various forms. A further possibility, which provides a simple approximation to the venturi diffuser form, is to manufacture the cross-plate from a composition of several perforated plates with different sizes of the perforations of each plate.

Figure 3:
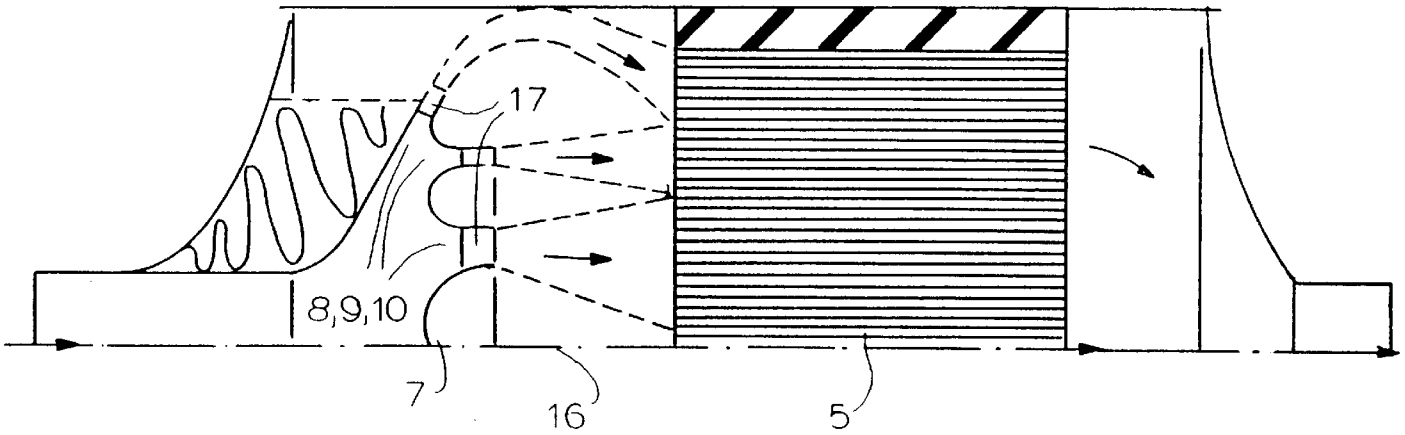

FIG. 3 shows a further embodiment of the invention, in which the number of apertures is much smaller than according to FIGS. 1 and 2. This calls for the necessity of a certain distance 16 to the catalyser element, as. The fewer, but bigger apertures of this figure can be seen as a simple method of preventing accumulated particulate matter from disturbing flows through apertures. In this embodiment the simplest method of manufacturing the cross-plate is to press it from metal sheet. The various parts are held together by means of ribs 17, which are axially aligned with the flow direction.

The flow dynamic design of diffuser forms according to FIG. 3 can be made from the theory of axisymmetrical potential flows as a starting point. Mathematical analysis reveals that classes of forms with pervaded cross-plates can be derived as rather simple solutions to the flow field equation. The final choice of diffuser forms will have to take various further aspects into consideration, including the effect of fluid flow friction, as well as manufacturing aspects.

The acoustic optimisation of the apparatus affects a number of design parameters, among them the distance between the cross-plate diffuser and the catalyst body. In case the effective flow cross-sectional area of the catalyst is rather big, the catalyst may only to a minor degree cause an acoustical division of the casing into sub-chambers. In such cases the flow exit inside the casing can be positioned in the middle along the axial direction, with the effect of suppressing the fundamental acoustical chamber mode, which (as previously mentioned) has a pressure node in the middle.

In other apparatuses the effective flow area of the catalyst may be more restricted, causing an effective acoustical division into sub-chambers. In such cases, in terms of suppression of chamber resonances, it is preferable to instead position the cross-plate halfway between the inlet end cap of the casing and the inlet face to the catalyst.

Figure 5:
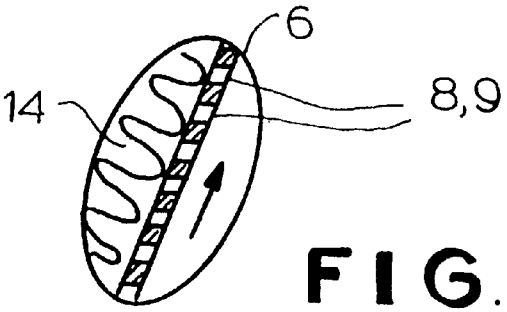
Figure 4:
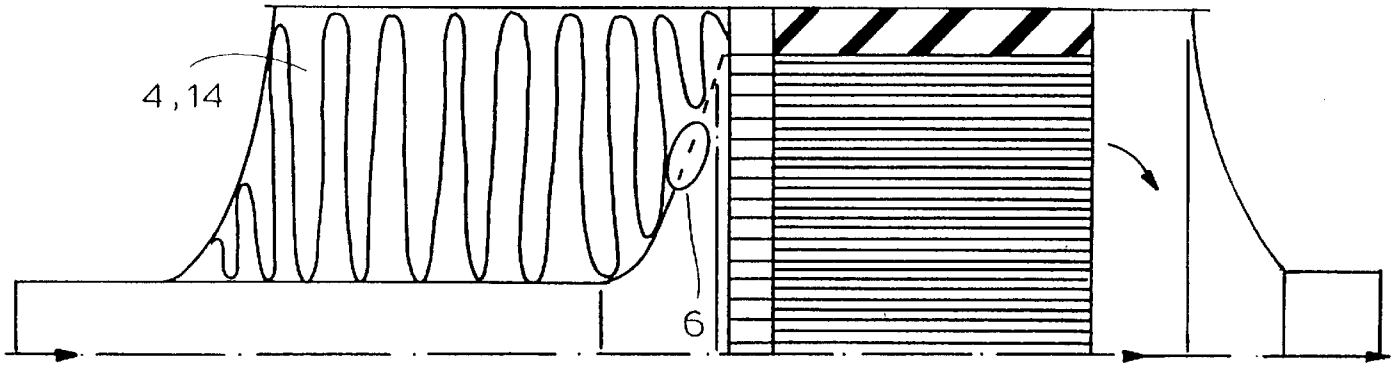

Finally, FIGS. 4 and 5 show an embodiment of the invention, in which some of the apertures 8 are perforations 9, which are not pervaded by flows, and which constitute an acoustical communication to the sound absorption material 14 contained within the compartment 4.

In order that the compartment 4 contributes significantly to the sound attenuation it is imperative that the effective opening area of this compartment to the rest of the apparatus is not too small.

We claim:

1. A silencer with a built-in catalyst for simultaneous sound attenuation and catalytic treatment of gases comprising: a casing connected to an inlet pipe and to an outlet pipe, a sound attenuation compartment having a substantial part which is not pervaded by the flow of gas, a downstream catalytic body, a flow-area widening diffuser element which is adapted to cause a substantial part of the flow of gas to flow with a substantial radial component and which extends from the inlet pipe and is contained within the compartment, and a cross-plate which is positioned between the diffuser element and the catalytic body and from which the flow is distributed evenly across the inlet to the catalytic body, at least two apertures being provided between the diffuser element and the catalytic body, at least one of the apertures providing a communication to the sound attenuation compartment and at least two of the apertures being pervaded by gas flows, the flow pervaded apertures having entrances provided with a curvature.

2. A silencer according to claim 1 where the flow pervaded apertures have downstream ends which comprise a flow cross-section expanding part.

3. A silencer according to claim 2 wherein the flow pervaded apertures have downstream ends which comprise a flow cross-section expanding part.

4. A silencer according to claim 1 wherein the flow pervaded apertures have surfaces which are coated by catalytic layers.

5. A silencer according to claim 1 wherein there is sound absorptive material within the compartment, and the diffuser element is provided with apertures which are not pervaded by flows and which constitute an acoustic communication to the sound absorptive material within the compartment.

6. A silencer according to claim 1 wherein a mechanical contact is established between the cross-plate and the catalytic body.

7. A silencer according to claim 1 wherein a distance is provided between the cross-plate and the catalytic body.

8. A silencer according to claim 1, wherein the sound attenuation compartment is around the inlet pipe, the diffuser element radially widens in the region toward the cross-plate and thereby defines the sound attenuation compartment, and the at least one aperture providing communication to the sound attenuation compartment being toward the radially outward region of the diffuser element toward the cross-plate.

* * * * *